US009598647B2

(12) United States Patent
Bourane et al.

(10) Patent No.: US 9,598,647 B2
(45) Date of Patent: Mar. 21, 2017

(54) PROCESS FOR OXIDATIVE DESULFURIZATION AND SULFONE DISPOSAL USING SOLVENT DEASPHALTING

(75) Inventors: Abdennour Bourane, Ras Tanura (SA); Omer Refa Koseoglu, Dhahran (SA); Stephane Cyrille Kressmann, Dhahran (SA)

(73) Assignee: SAUDI ARABIAN OIL COMPANY, Saudi Arabia (SA)

( * ) Notice: Subject to any disclaimer, the term of this patent is extended or adjusted under 35 U.S.C. 154(b) by 19 days.

(21) Appl. No.: 12/876,636

(22) Filed: Sep. 7, 2010

(65) Prior Publication Data

US 2012/0055843 A1 Mar. 8, 2012

(51) Int. Cl.
*C10G 27/04* (2006.01)
*C10G 21/20* (2006.01)
(Continued)

(52) U.S. Cl.
CPC ..... *C10G 27/04* (2013.01); *C10G 21/003* (2013.01); *C10G 21/06* (2013.01); *C10G 21/12* (2013.01);
(Continued)

(58) Field of Classification Search
CPC ..... C01B 2203/0261; C01B 2203/127; C01B 2203/84; C01B 3/386; C10G 21/12; C10G 2300/1037; C10G 2300/1055; C10G 2300/202; C10G 2300/207; C10G 2300/44; C10G 27/04; C10G 27/12; C10G 27/14; C10G 53/04; C10G 53/08; C10G 53/14
(Continued)

(56) References Cited

U.S. PATENT DOCUMENTS 2,704,295 A 3/1955 Gilbert et al.
2,993,841 A * 7/1961 Sarno ..... C07C 7/08 203/51
(Continued)

FOREIGN PATENT DOCUMENTS

WO 0218518 A1 3/2002
WO 03014266 A1 2/2003
(Continued)

OTHER PUBLICATIONS

Gillis, et al., What's New in Solvent Deasphalting?, 1998, Heavy Oils Conference, pp. 1-13.*
(Continued)

*Primary Examiner* — Renee E Robinson
*Assistant Examiner* — Derek Mueller
(74) *Attorney, Agent, or Firm* — Bracewell LLP; Constance Gall Rhebergen; Brad Y. Chin

(57) ABSTRACT

A method and apparatus for upgrading a hydrocarbon feedstock is provided. The method includes the steps of (a) supplying a hydrocarbon feedstock to an oxidation reactor, wherein the hydrocarbon feedstock is oxidized in the presence of a catalyst under conditions sufficient to selectively oxidize sulfur compounds present in the hydrocarbon feedstock; (c) separating the hydrocarbons and the oxidized sulfur compounds by solvent extraction; (d) collecting a residue stream that includes the oxidized sulfur compounds; and (e) supplying the residue stream to a deasphalting unit.

17 Claims, 3 Drawing Sheets

(51) Int. Cl.

| | |
|---|---|
| ***C10G 53/08*** | (2006.01) |
| ***C10G 53/14*** | (2006.01) |
| ***C10G 21/00*** | (2006.01) |
| ***C10G 21/06*** | (2006.01) |
| ***C10G 21/12*** | (2006.01) |
| ***C10G 21/16*** | (2006.01) |
| ***C10G 21/22*** | (2006.01) |
| ***C10G 21/28*** | (2006.01) |
| ***C10G 25/00*** | (2006.01) |
| ***C10G 27/12*** | (2006.01) |
| ***C10G 53/04*** | (2006.01) |

(52) U.S. Cl.
CPC ..... *C10G 21/16* (2013.01); *C10G 21/22* (2013.01); *C10G 21/28* (2013.01); *C10G 25/003* (2013.01); *C10G 27/12* (2013.01); *C10G 53/04* (2013.01); *C10G 53/08* (2013.01); *C10G 53/14* (2013.01); *C10G 2300/202* (2013.01); *C10G 2300/206* (2013.01); *C10G 2300/44* (2013.01)

(58) Field of Classification Search
USPC ..... 208/208 R, 45, 240, 249
See application file for complete search history.

(56) References Cited

U.S. PATENT DOCUMENTS

| | | | | |
|---|---|---|---|---|
| 3,551,328 | A | 12/1970 | Cole et al. | |
| 3,816,301 | A | 6/1974 | Sorgenti | |
| 5,958,224 | A | 9/1999 | Ho et al. | |
| 5,961,820 | A | 10/1999 | Jeanblanc et al. | |
| 6,087,544 | A | 7/2000 | Wittenbrink et al. | |
| 6,160,193 | A * | 12/2000 | Gore | 585/833 |
| 6,277,271 | B1 | 8/2001 | Kocal | |
| 6,402,940 | B1 | 6/2002 | Rappas | |
| 6,596,914 | B2 | 7/2003 | Gore et al. | |
| 6,673,236 | B2 | 1/2004 | Stanciulescu et al. | |
| 7,179,368 | B2 | 2/2007 | Rabion et al. | |
| 7,252,756 | B2 | 8/2007 | Gong et al. | |
| 7,374,666 | B2 | 5/2008 | Wachs | |
| 7,491,316 | B2 | 2/2009 | Ketley et al. | |
| 2005/0150819 | A1 | 7/2005 | Wachs | |
| 2005/0189261 | A1 | 9/2005 | Briot et al. | |
| 2006/0180501 | A1 | 8/2006 | Da Silva et al. | |
| 2006/0226049 | A1 | 10/2006 | Nemeth et al. | |
| 2007/0051667 | A1 | 3/2007 | Martinie et al. | |
| 2007/0102323 | A1 * | 5/2007 | Lee et al. | 208/208 R |

FOREIGN PATENT DOCUMENTS

| | | | |
|---|---|---|---|
| WO | 2006071793 | A1 | 7/2006 |
| WO | 2007106943 | A1 | 9/2007 |

OTHER PUBLICATIONS

International Search Report and Written Opinion issued in PCT Application No. PCT/US2011/050590, mailed Nov. 22, 2011 (16 pages).

Ebbe R. Skov et al.: "The ULSD oxidative desulfurisation option", Hydrocarbon Engineering (Reprinted from May 2007) May 31, 2007, pp. 1-5.

M. Sattarin et al.: "Solvent Deasphalting of Vacuum Residue in a Bench-scale Unit", Petroleum & Coal, vol. 48, No. 3, Dec. 31, 2006, pp. 14-19.

Farhan Al-Shahrani et al.: "Desulfurization of diesel via the H2O2 oxidation of aromatic sulfides to sulfones using a tungstate catalyst", Applied Catalysis B: Environmental, vol. 73, Jan. 7, 2007, pp. 311-316.

F. Zannikos et al.: "Desulfurization of petroleum fractions by oxidation and solvent extraction", Fuel Processing Technology, vol. 42, Dec. 31, 1995, pp. 35-45.

Atsushi Ishihara et al.: "Oxidative desulfurization and denitrogenation of a light gas oil using an oxidation/adsorption continuous flow process", Applied Catalysis A: General, Dec. 31, 2005. pp. 279-287.

H. Mei et al.: "A new method for obtaining ultra-low sulfur diesel fuel via ultrasound assisted oxidative desulfurization", Fuel, vol. 82, Oct. 22, 2002, pp. 405-414.

Ron Gatan et al.: "Oxidative Desulfurization: A New Technology for ULSD", Prepr. Pap.-Am. Chem. Soc. Div. Fuel Chem. vol. 49, No. 2, Dec. 31, 2004, pp. 577-579.

Alberto de Angelis et al.: "Heteropolyacids as effective catalysts to obtain zero sulfur diesel", Pure Appl. Chem., vol. 79, No. 11, Dec. 31, 2007, pp. 1887-1894.

Sulphco: "Oxidative Desulfurization", IAEE Houston Chapter, Jun. 11, 2009, pp. 1-8.

PCT Written Opinion of the International Preliminary Examining Authority dated Feb. 1, 2013; International Application No. PCT/US2011/050590; International File Date: Sep. 7, 2011.

* cited by examiner

PROCESS FOR OXIDATIVE DESULFURIZATION AND SULFONE DISPOSAL USING SOLVENT DEASPHALTING

FIELD OF THE INVENTION

This invention relates to a method and apparatus for desulfurizing a hydrocarbon feedstock. More specifically, the present invention relates to a method and apparatus for oxidative desulfurization of a hydrocarbon stream and the subsequent disposal of resulting oxidized sulfur and nitrogen compounds.

BACKGROUND OF THE INVENTION

Crude oil is the world's main source of hydrocarbons used as fuel and petrochemical feedstock. At the same time, petroleum and petroleum based products are also a major source for air and water pollution today. To address growing concerns surrounding pollution caused by petroleum and petroleum based products, many countries have implemented strict regulations on petroleum products, particularly on petroleum refining operations and the allowable concentrations of specific pollutants in fuels, such as the allowable sulfur and nitrogen content in gasoline fuels. While the exact compositions of natural petroleum or crude oils vary significantly, all crude oils contain some measurable amount of sulfur compounds and most crude oils also contain some measurable amount of nitrogen compounds. In addition, crude oils may also contain oxygen, but oxygen content of most crude is low. Generally, sulfur concentrations in crude oils are less than about 5 percent by weight, with most crude oils having sulfur concentrations in the range from about 0.5 to about 1.5 percent by weight. Nitrogen concentrations of most crude oils are usually less than 0.2 percent by weight, but can be as high as 1.6 percent by weight. In the United States, motor gasoline fuel is regulated to have a maximum total sulfur content of less than 10 ppm sulfur, thus the removal of sulfur is a key concern.

Crude oils are refined in oil refineries to produce transportation fuels and petrochemical feedstocks. Typically fuels for transportation are produced by processing and blending of distilled fractions from the crude oil to meet the particular end use specifications. Because most of the crudes generally available today have high concentrations of sulfur, the distilled fractions typically require desulfurization to yield products which meet various performance specifications and/or environmental standards.

The sulfur-containing organic compounds present in crude oils and resulting refined fuels can be a major source of environmental pollution. The sulfur compounds are typically converted to sulfur oxides during the combustion process, which in turn can produce sulfur oxyacids and contribute to particulate emissions, both of which are desired to be reduced.

One method for reducing particulate emissions includes the addition of various oxygenated fuel blending compounds and/or compounds that contain few or no carbon-to-carbon chemical bonds, such as methanol and dimethyl ether. Most of these fuel blending compounds, however, suffer in that they can have high vapor pressures, be nearly insoluble in diesel fuel, and/or have poor ignition quality, as indicated by their cetane numbers.

Hydrotreating and hydrogenation are alternate techniques currently used for the removal of sulfur and/or nitrogen from hydrocarbons. Diesel fuels that have been treated by chemical hydrotreating and/or hydrogenation to reduce the content of sulfur and aromatic compounds can have a reduced fuel lubricity, which in turn can cause excessive wear of fuel pumps, injectors and other moving parts that come in contact with the fuel under high pressures.

For example, middle distillates (a distillate fraction that nominally boils in the range of about 180-370° C.) can be used directly as a fuel, or alternatively can be used as a blending component of fuel for use in compression ignition internal combustion engines (i.e., diesel engines). The middle distillate fraction typically include between about 1 and 3% by weight sulfur, which is greater than the allowable sulfur concentration in middle distillate fractions, which since 1993, have been reduced in Europe and the United States to between a currently allowed amount of about 5-50 part per million weight (ppmw) levels from the 3000 ppmw level.

Current conventional techniques for the removal of sulfur and nitrogen compounds typically still require the subsequent disposal of the sulfur and nitrogen compounds that are removed from the hydrocarbons. In order to comply with the increasingly stringent regulations for ultra-low sulfur content fuels, refiners must make fuels having even lower sulfur levels at the refinery gate so that they can meet the specifications after blending.

Low pressure conventional hydrodesulfurization (HDS) processes can be used to remove a major portion of the sulfur from petroleum distillates for the eventual blending of refinery transportation fuels. These desulfurization units, however, are not very efficient at removing sulfur from compounds at mild conditions (i.e., up to about 30 bar pressure), or when the sulfur atom is sterically hindered as in multi-ring aromatic sulfur compounds. This is particularly true where the sulfur heteroatom is hindered by two alkyl groups (e.g., 4,6-dimethyldibenzothiophene). Because of the difficulty in the removal of the sterically hindered compounds, dibenzothiophenes predominate at low sulfur levels such as 50 to 100 ppmw. Severe operating conditions (i.e., high hydrogen partial pressure, high temperature, and/or high catalyst volume) must be utilized in order to remove the sulfur from these refractory sulfur compounds. Increasing the hydrogen partial pressure can only be achieved by increasing the recycle gas purity, or new grassroots units must be designed, which can be a very costly option. The use of severe operating conditions typically results in decreased yield, lower catalyst life cycle, and product quality deterioration (e.g., color), and therefore are typically sought to be avoided.

Conventional methods for petroleum upgrading, specifically for the removal of sulfur and/or nitrogen containing compounds, however, suffer from various limitations and drawbacks. For example, hydrogenative methods typically require large amounts of hydrogen gas to be supplied from an external source to attain desired upgrading and conversion. These methods can also suffer from premature or rapid deactivation of catalyst, as is typically the case during hydrotreatment of a heavy feedstock and/or hydrotreatment under harsh conditions, thus requiring regeneration of the catalyst and/or addition of new catalyst, which in turn can lead to process unit downtime. Thermal methods frequently suffer from the production of large amounts of coke as a byproduct and a limited ability to remove impurities, such as, sulfur and nitrogen, in addition to the large energy requirements associated with these processes. Additionally, thermal methods require specialized equipment suitable for severe conditions (high temperature and high pressure), and require the input of significant energy, thereby resulting in increased complexity and cost.

Thus, there exists a need to provide a process for the upgrading of hydrocarbon feedstocks, particularly processes for the desulfurization and/or denitrogenation of hydrocarbons that use low severity conditions that can also provide means for the recovery and disposal of usable sulfur and/or nitrogen compounds.

SUMMARY

The current invention provides a method and apparatus for the upgrading of a hydrocarbon feedstock that removes a major portion of the sulfur containing compounds present in the feedstock and in turn utilizes these sulfur containing compounds in an associated process. Removal of nitrogen containing compounds from the feedstock can similarly be achieved by the method and apparatus.

In one aspect, a method of upgrading a hydrocarbon feedstock is provided. The method includes the steps of: supplying a hydrocarbon feedstock to an oxidation reactor, wherein the hydrocarbon feedstock includes sulfur containing compounds; contacting the hydrocarbon feedstock in the oxidation reactor with an oxidant in the presence of a catalyst and under conditions sufficient to selectively oxidize sulfur containing compounds present in the hydrocarbon feedstock to produce an oxidized hydrocarbon stream that includes hydrocarbons and oxidized sulfur containing compounds; separating the hydrocarbons and the oxidized sulfur compounds in the oxidized hydrocarbon stream by solvent extraction with a polar solvent to produce an extracted hydrocarbon stream and a mixed stream, the mixed stream including the polar solvent and the oxidized sulfur containing compounds, wherein the extracted hydrocarbon stream has a lower concentration of sulfur than the hydrocarbon feedstock; separating the mixed stream into a first recovered polar solvent stream and a first residue stream; and supplying the first residue stream to a deasphalting unit to produce a deasphalted oil stream and a pitch stream, wherein the pitch stream includes a substantial portion of the oxidized sulfur containing compounds removed from the hydrocarbon feedstock.

In certain embodiments, the oxidants are selected from the group consisting of air, oxygen, oxides of nitrogen, peroxides, hydroperoxides, organic peracids, and combinations thereof. In certain embodiments, the catalyst is a metal oxide having the formula $M_xO_y$, wherein M is an element selected from Groups IVB, VB, and VIB of the periodic table. In certain embodiments, the polar solvent has a Hildebrandt value of greater than about 19. In certain embodiments, the method can include the step of supplying the extracted hydrocarbon stream to an adsorption column, wherein the adsorption column is charged with an adsorbent suitable for the removal of oxidized compounds present in the extracted hydrocarbon stream to produce a high purity hydrocarbon product stream and a second residue stream, wherein the second residue stream includes at least a portion of the oxidized sulfur containing compounds and oxidized nitrogen containing compounds.

In another aspect, a method of upgrading a hydrocarbon feedstock is provided. The method includes the steps of supplying the hydrocarbon feedstock to an oxidation reactor, wherein the hydrocarbon feedstock includes sulfur containing compounds. The sulfur containing compounds in the hydrocarbon feedstock are catalytically oxidized in the oxidation reactor with an oxidant, and in the presence of a catalyst, under conditions sufficient to selectively oxidize the sulfur containing compounds present in the hydrocarbon feedstock to sulfones, and to produce a treated hydrocarbon stream that includes hydrocarbons and sulfones. The treated hydrocarbon stream is extracted with a polar organic solvent to produce an extracted hydrocarbon stream and a mixed stream, wherein the mixed stream including the polar organic solvent and the sulfones, and wherein the extracted hydrocarbon stream has a lower sulfur concentration than the hydrocarbon feedstock. The mixed stream is separated into a first recovered polar solvent stream and a first residue stream, wherein the first residue stream includes sulfones. The extracted hydrocarbon stream is supplied to a stripper, wherein the stripper is operable to separate the extracted hydrocarbon stream into a stripped oil stream and a second recovered polar solvent stream. The first recovered polar solvent stream and second recovered polar solvent stream are supplied to the extraction step. The residue stream that includes sulfones is supplied to a solvent deasphalting unit and the residue stream is extracted with a paraffinic solvent having between 3 and 7 carbon atoms to produce a deasphalted oil stream and a pitch stream, wherein said extraction of the residue stream is conducted a temperature and pressure that is at or below the supercritical temperature and pressure of the paraffinic solvent.

In another aspect, an apparatus for upgrading a hydrocarbon feedstock that includes sulfur containing compounds is provided. The apparatus includes: an oxidation vessel, wherein oxidation vessel includes input lines for supplying the hydrocarbon feedstock, a catalyst, and an oxidant to the oxidation vessel, and an output line for withdrawing a treated hydrocarbon stream comprising oxidized sulfur containing compounds; an extraction vessel for contacting the treated hydrocarbon stream that includes oxidized sulfur containing compounds with a solvent stream, said extraction vessel including inputs for supplying the treated hydrocarbon stream and the polar solvent, and further including outputs for removal of an extracted hydrocarbon stream and a mixed stream that includes the extraction solvent and oxidized sulfur compounds; a distillation column for separating the mixed stream into a solvent recycle stream and a residue stream including oxidized sulfur compounds, the distillation column including an input for supplying the mixed stream and outputs for the removal of the solvent recycle stream and the residue stream; and a solvent deasphalter, the solvent deasphalter including at least one input for receiving the residue stream, a paraffinic solvent, and a pitch stream, and an output for the removal of a deasphalted oil stream.

DETAILED DESCRIPTION OF THE INVENTION

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, relating to the claimed invention.

The present invention addresses problems associated with prior art methods upgrading a hydrocarbon feedstock, particularly the desulfurization and denitrogenation of hydrocarbon feedstocks, and the subsequent removal and recovery of usable sulfur compounds. In one aspect, the present invention provides a method for the removal of sulfur from a hydrocarbon feedstock and the use of oxidized sulfur containing species in a deasphalting process.

As used herein, the terms "upgrading" or "upgraded", with respect to petroleum or hydrocarbons refers to a petroleum or hydrocarbon product that is lighter (i.e., has fewer carbon atoms, such as methane, ethane, and propane . . . ), has a higher API gravity, higher middle distillate yield, lower sulfur content, lower nitrogen content, or lower metal content, than does the original petroleum or hydrocarbon feedstock.

As used herein, oxidized sulfur and oxidized nitrogen containing hydrocarbon stream refers to a hydrocarbon stream that includes the oxidized sulfur and/or oxidized nitrogen containing compounds.

Figure 1:
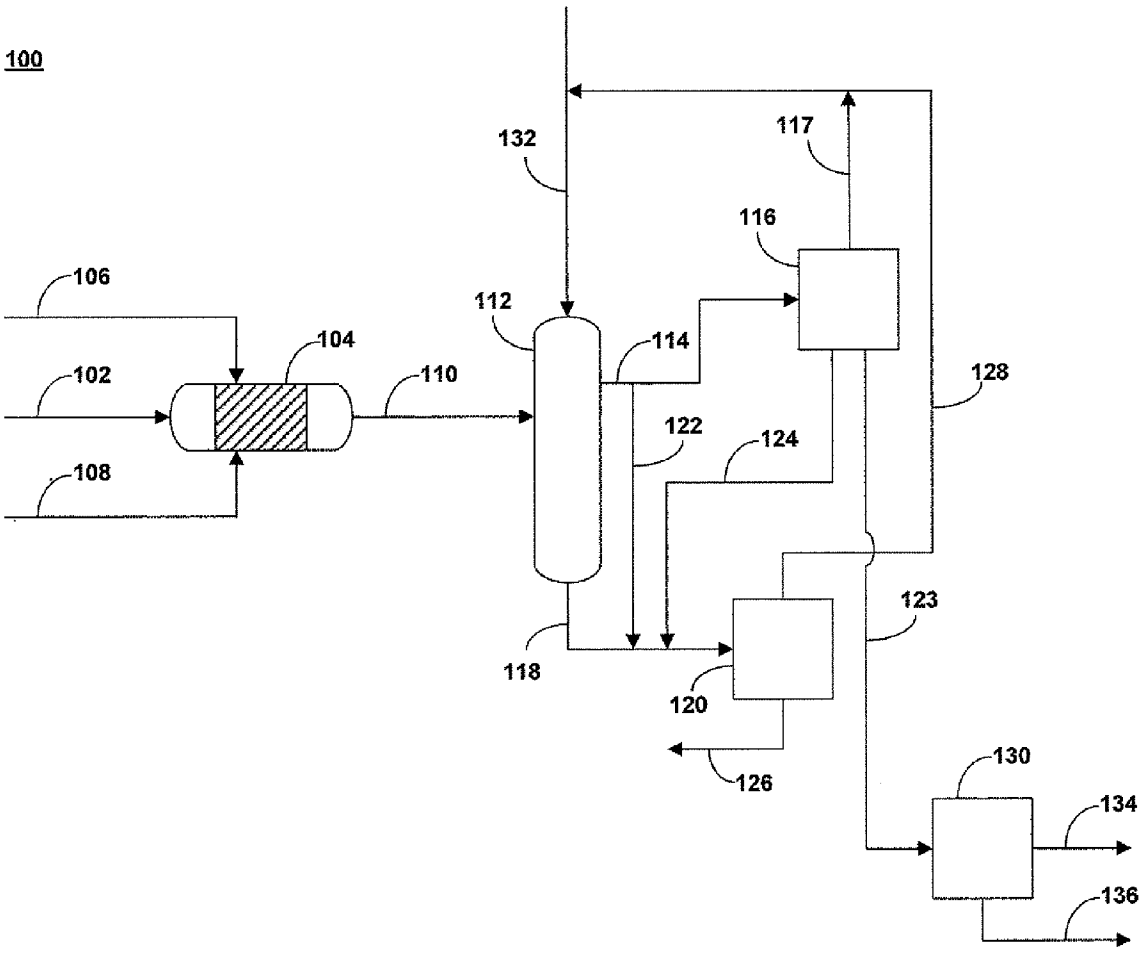
FIG. 1 provides a schematic diagram of one embodiment of the method of upgrading a hydrocarbon feedstock according to the present invention.

FIG. 1 provides one embodiment of the present invention for the upgrading of hydrocarbons. Hydrocarbon upgrading system 100 includes oxidation reactor 104, extraction vessel 112, solvent regeneration column 116, stripper 120 and deasphalting unit 130.

In one aspect, the present invention provides a method for the upgrading of a hydrocarbon feedstock, particularly a hydrocarbon feedstock that includes sulfur containing compounds. In certain embodiments, the hydrocarbon feedstock can include nitrogen containing species that can also be oxidized and removed in addition to or instead of the sulfur species. The method includes supplying hydrocarbon feedstock 102 to oxidation reactor 104, where the hydrocarbon feedstock is contacted with an oxidant and a catalyst. The oxidant can be supplied to oxidation reactor 104 via oxidant feed line 106 and fresh catalyst can be supplied to the reactor via catalyst feed line 108. In certain embodiments, the catalyst can be regenerated from this or another process, and supplied along with, or in the place of, fresh catalyst.

Hydrocarbon feedstock 102 can be any petroleum based hydrocarbon, and can include various impurities, such as elemental sulfur, and/or compounds that include sulfur and/or nitrogen. In certain embodiments, hydrocarbon feedstock 102 can be diesel oil having a boiling point between about 150° C. and 400° C. Alternatively, hydrocarbon feedstock 102 can have a boiling point up to about 450° C., alternatively up to about 500° C. Alternatively, hydrocarbon feedstock 102 can have a boiling point between about 100° C. and 500° C. Optionally, hydrocarbon feedstock 102 can have a boiling point up to about 600° C., alternatively up to about 700° C., or, in certain embodiments, greater than about 700° C. In certain embodiments, hydrocarbon feedstock 102 can be a solid residue. In certain embodiments, hydrocarbon feedstock 102 can include heavy hydrocarbons. As used herein, heavy hydrocarbons refers to hydrocarbons having a boiling point of greater than about 360° C., and can include aromatic hydrocarbons and naphthenes, as well as alkanes and alkenes. Generally, in certain embodiments, hydrocarbon feedstock 102 can be selected from whole range crude oil, topped crude oil, product streams from oil refineries, product streams from refinery steam cracking processes, liquefied coals, liquid products recovered from oil or tar sand, bitumen, oil shale, asphaltene, and the like, and mixtures thereof.

Exemplary sulfur compounds present in hydrocarbon feedstock 102 can include sulfides, disulfides, and mercaptans, as well as aromatic molecules such as thiophenes, benzothiophenes, dibenzothiophenes, and alkyl dibenzothiophenes, such as 4,6-dimethyldibenzothiophene. Aromatic compounds are typically more abundant in higher boiling fractions, than is typically found in the lower boiling fractions.

As noted previously, in certain embodiments the feedstock can include nitrogen containing compounds present in hydrocarbon feedstock 102, and in certain embodiments exemplary compounds can include basic and neutral nitrogen compounds, including indoles, carbazoles, anilines, quinolines, acridines, and the like. Oxidation reactor 104 can be operated at mild conditions, relative to the conditions typically used in conventional hydrodesulfurization processes for diesel type feedstock. More specifically, in certain embodiments, oxidation reactor 104 can be maintained at a temperature of between about 20° C. and about 150° C., alternatively between about 30° C. and about 150° C., alternatively between about 30° C. and about 90° C., or between about 90° C. and about 150° C. In certain embodiments, the temperature is preferably between about 30° C. and about 75° C., more preferably between about 45° C. and 60° C. The operating pressure of oxidation reactor 104 can be between about 1 and 30 bars, alternatively between about 1 and 15 bars, alternatively between about 1 and 80 bars, alternatively between about 1 and 30 bars, alternatively between about 1 and 15 bars, and preferably between about 2 and 3 bars. The residence time of the hydrocarbon feedstock within oxidation rector 102 can be between about 1 and 180 minutes, alternatively between about 15 and 180 minutes, alternatively between about 15 and 90 minutes, alternatively between about 5 and 60 minutes, alternatively between about 30 and 60 minutes, alternatively between about 60 and 120 minutes, alternatively between about 120 and 180 minutes, and is preferably for a sufficient amount of time for the oxidation of any sulfur or nitrogen compounds present in the hydrocarbon feedstock. In one embodiment, the residence time of the hydrocarbon feedstock within oxidation rector 104 is between about 15 and 45 minutes. For comparison, conventional hydrodesulfurization of a diesel type feedstock is typically conducted under harsher conditions, for example, at temperatures of between about 330 and 380° C., pressures of between about 50 and 80 $Kg/cm^2$, and LHSV of between about 0.5 and 2 $h^{-1}$.

Oxidation reactor 104 can be any reactor suitably configured to ensure sufficient contacting between hydrocarbon feedstock 102 and the oxidant, in the presence of a catalyst, for the oxidation of at least a portion of the sulfur and nitrogen containing compounds contained therein. Suitable reactors for oxidation reactor 104 can include batch reactors, fixed bed reactors, ebullated bed reactors, lifted reactors, fluidized bed reactors, slurry bed reactors, and the like. Certain sulfur and nitrogen compounds present in hydrocarbon feedstock 102 are oxidized in oxidation reactor 104 to sulfones, sulfoxides, and oxidized nitrogen compounds, which can be subsequently removed by extraction and/or adsorption. Exemplary oxidized nitrogen compounds can include pyridine and pyrrole-based compounds or pyridine-difuran compounds. Frequently, during oxidation, the nitrogen atom itself is not oxidized, but rather the compound is oxidized to a compound that is easy to separate from the remaining compounds.

The oxidant is supplied to oxidation reactor 104 via oxidant feed stream 106. Suitable oxidants can include air, oxygen, ozone, hydrogen peroxide, organic peroxides, hydroperoxides, organic peracids, peroxo acids, oxides of nitrogen, and the like, and combinations thereof. Exemplary peroxides can be selected from hydrogen peroxide, and the like. Exemplary hydroperoxides can be selected from t-butyl hydroperoxide, and the like. Exemplary organic peracids can be selected from peracetic acid, and the like.

In certain embodiments, such as for hydrocarbon feedstocks having a greater concentration of sulfur than nitrogen, the mole ratio of oxidant to sulfur present in the hydrocarbon feedstock can be from about 1:1 to 50:1, preferably between about 2:1 and 20:1, more preferably between about 4:1 and 10:1.

In certain other embodiments, such as for hydrocarbon feedstocks having a greater concentration of nitrogen than sulfur, for example, certain South American crude oils, certain African crude oils, certain Russian crude oils, certain Chinese crude oils, and certain intermediate refinery streams like coker, theiuial cracking, visbreaking, FCC cycle oils, and the like, the mole ratio of oxidant to nitrogen present in the hydrocarbon feedstock can be from about 1:1 to 50:1, preferably between about 2:1 and 20:1, more preferably between about 4:1 and 10:1.

The catalyst can be supplied to oxidation reactor 104 via catalyst feed stream 108. The catalyst can include at least one metal oxide having the chemical formula $M_xO_y$, wherein M is a metal selected from groups IVB, VB, or VIB of the periodic table. Certain exemplary catalysts can be homogeneous catalysts that include one or more metal oxide. Exemplary metals can include titanium, vanadium, chromium, molybdenum, and tungsten. Certain preferred metals include oxides of molybdenum and tungsten.

In certain embodiments, such as the use of aqueous oxidants, spent catalyst can be removed from the system with the aqueous phase, after the oxidation vessel. Catalyst remaining in the hydrocarbon stream can be removed or disposed of in the solvent deasphalting step. In certain embodiments, the catalyst can be regenerated and recycled. In certain other embodiments, the catalyst is not regenerated and is not recycled.

The ratio of catalyst to oil is between about 0.1% by weight and about 10% by weight, preferably between about 0.5% by weight and about 5% by weight. In certain embodiments, the ratio is between about 0.5% by weight and about 2.5% by weight. Alternatively, the ratio is between about 2.5% by weight and about 5% by weight.

Catalyst present in oxidation reactor 104 can increase the rate of oxidation of the various sulfur and/or nitrogen containing compounds in hydrocarbon feedstock 102, and/or reduce the amount of oxidant necessary for the oxidation reaction, thereby achieving completion of the reaction and oxidation of sulfur and nitrogen containing compounds in a shorter amount of time, and/or with a reduced amount of oxidant necessary to achieve oxidation of the sulfur and nitrogen containing compounds. In certain embodiments, the catalyst can be selective toward the oxidation of sulfur containing compounds. In preferred embodiments, the catalyst is selective to minimizing the oxidation of aromatic hydrocarbons present in the hydrocarbon feedstock.

The composition of spent oxidant will vary based upon what original oxidant is used in the process. For example, in embodiments wherein the oxidant is hydrogen peroxide, water is formed as a by-product of the oxidation reaction. In embodiments wherein the oxidant is an organic peroxide, alcohol is formed as a by-product of the oxidation reaction. By-products are typically removed during the extraction and solvent recovery steps.

Oxidation reactor 102 produces oxidized sulfur and oxidized nitrogen containing hydrocarbon stream 110, which can include hydrocarbons, oxidized sulfur containing species, and in certain embodiments nitrogen containing species. Oxidized hydrocarbon stream 110 is supplied to extraction vessel 112 where the oxidized hydrocarbon stream and oxidized sulfur and nitrogen containing species are contacted with extraction solvent stream 132. The extraction solvent can be a polar solvent, and in certain embodiments, can have a Hildebrandt solubility value of greater than about 19. In certain embodiments, when selecting the particular polar solvent for use in extracting oxidized sulfur and nitrogen containing species, selection may be based upon, in part, solvent density, boiling point, freezing point, viscosity, and surface tension. Exemplary polar solvents suitable for use in the extraction step can include acetone (Hildebrand value of 19.7), carbon disulfide (20.5), pyridine (21.7), dimethyl sulfoxide (DMSO) (26.4), n-propanol (24.9), ethanol (26.2), n-butyl alcohol (28.7), propylene glycol (30.7), ethylene glycol (34.9), dimethylformamide (DMF) (24.7), acetonitrile (30), methanol (29.7), and the like. In certain embodiments, acetonitrile and methanol, due to their low cost, volatility, and polarity, are preferred. In certain embodiments, solvents that include sulfur, nitrogen, or phosphorous, preferably have a relatively high volatility to ensure adequate stripping of the solvent from the hydrocarbon feedstock.

In preferred embodiments, the extraction solvent is non-acidic. The use of acids is typically avoided due to the corrosive nature of acids, and the requirement that all equipment be specifically designed for a corrosive environment. In addition, acids, such as acetic acid, can present difficulties in separation due to the formation of emulsions.

Extraction vessel 112 can be operated at a temperature of between about 20° C. and 60° C., preferably between about 25° C. and 45° C., even more preferably between about 25° C. and 35° C. Extraction vessel 112 can operate at a pressure of between about 1 and 10 bars, preferably between about 1 and 5 bars, more preferably between about 1 and 2 bars. In certain embodiments, extraction vessel 112 operates at a pressure of between about 2 and 6 bars.

The ratio of the extraction solvent to hydrocarbon feedstock can be between about 1:3 and 3:1, preferably between about 1:2 and 2:1, more preferably about 1:1. Contact time between the extraction solvent and oxidized sulfur and oxidized nitrogen containing hydrocarbon stream 110 can be between about 1 second and 60 minutes, preferably between about 1 second and about 10 minutes. In certain preferred embodiments, the contact time between the extraction solvent and oxidized sulfur and oxidized nitrogen containing hydrocarbon stream 110 is less than about 15 minutes. In certain embodiments, extraction vessel 112 can include various means for increasing the contact time between the extraction solvent and oxidized sulfur and oxidized nitrogen containing hydrocarbon stream 110, or for increasing the degree of mixing of the two solvents. Means for mixing can include mechanical stirrers or agitators, trays, or like means.

The extraction vessel produces mixed stream 114 that can include extraction solvent, oxidized species (e.g., the oxidized sulfur and nitrogen species that were originally present in hydrocarbon feedstock 102), and traces of the hydrocarbon feedstock, and extracted hydrocarbon stream 118, which can include the hydrocarbon feedstock having a reduced sulfur and low nitrogen content, relative to hydrocarbon feedstock 102. Typically, the hydrocarbon feedstock is only present in mixed stream 114 in trace amounts.

Mixed stream 114 is supplied to solvent regeneration column 116 where extraction solvent can be recovered as first recovered solvent stream 117 and separated from first residue stream 123, which includes oxidized sulfur and nitrogen compounds. Optionally, mixed stream 114 can be separated in solvent regeneration column 116 into a recovered hydrocarbon stream 124, which can include hydrocarbons present in mixed stream 114 from hydrocarbon feedstock 102. Solvent regeneration column 116 can be a distillation column that is configured to separate mixed stream 114 into first recovered solvent stream 117, first residue stream 123, and recovered hydrocarbon stream 124.

Extracted hydrocarbon stream 118 can be supplied to stripper 120, which can be a distillation column or like vessel designed to separate a hydrocarbon product stream from the residual extraction solvent. In certain embodiments, a portion of mixed stream 114 can be supplied to stripper 120 via line 122, and may optionally be combined with extracted hydrocarbon stream 118. In certain embodiments, solvent regeneration column 116 can produce recovered hydrocarbon stream 124, which can be supplied to stripper 120, where the recovered hydrocarbon stream can be contacted with extracted hydrocarbon stream 118 and/or a portion of mixed stream 114, which can be supplied to the stripper via line 122.

Stripper 120 separates the various streams supplied thereto into stripped oil stream 126, which includes hydrocarbons present in hydrocarbon feedstock 102 and has a reduced sulfur and nitrogen content relative thereto, and second recovered solvent stream 128.

Stripper 120 separates the various streams supplied thereto into stripped oil stream 126, which includes hydrocarbons present in hydrocarbon feedstock 102 and has a reduced sulfur and nitrogen content relative thereto, and second recovered solvent stream 128.

In certain embodiments, first recovered solvent stream 117 can be combined with second recovered solvent stream 128 and recycled to extraction vessel 112. Optionally, make-up solvent stream 132, which can include fresh solvent, can be combined with first recovered solvent stream 117 and/or second recovered solvent stream 128 and supplied to extraction vessel 112. Alternately, extraction vessel 112 can be supplied completely with a polar solvent recovered from stream 117 and/or stream 128.

First residue stream 123, which can include oxidized sulfur containing compounds and/or oxidized nitrogen containing compounds, and which can also include trace amounts of hydrocarbonaceous material, can be supplied to deasphalting unit 130 where the solvent deasphalting process can be used to prepare valuable products for use as a source of road asphalt. Specifically, oxidized compounds such as the oxidized sulfur containing hydrocarbons, for example sulfones, and oxidized nitrogen compounds, can be included in road asphalt compositions. The use of the oxidized compounds in asphalt compositions can reduce and/or eliminate the need to use alternative methods for the removal of the oxidized sulfur and oxidized nitrogen containing species, such as a conventional hydrotreating step employing the addition of hydrogen and/or disposal the hydrogen sulfide via a Claus unit. In one embodiment of the present invention, oxidized sulfur compounds, such as sulfones, are embedded in heavy hydrocarbons, such as hydrocarbons having a boiling point of greater than about 520° C., and subsequently used for the preparation of the asphalt road. Solvent deasphalting processes can also be used to produce lube oil, or can be used to produce a vacuum bottom straight run from heavy crude to produce fuel oil.

Solvent deasphalting results in the separation of compounds based upon solubility and polarity, rather than by boiling point, as is the case with the vacuum distillation processes that are currently used to produce a low-contaminant deasphalted oil MAO), which can be rich in paraffinic-type hydrocarbon molecules. The lower molecular weight fractions can then be further processed in conventional conversion units, for example, an FCC unit or hydrocracking unit. Solvent deasphalting usually can be carried out with paraffin solvent streams having between 3 and 7 carbon atoms, preferably between about 4 and 5 carbon atoms, at or below the critical conditions of the paraffin solvent.

A processed hydrocarbon feed is dissolved in the paraffin solvent, and an insoluble pitch precipitates therefrom. Separation of the deasphalted oil phase and the pitch phase can occur in an extractor (not shown), which can be designed to efficiently separate the two phases and minimize contaminant entrainment in the deasphalted oil phase. Typically, the deasphalted oil phase is heated to conditions, such that the extraction solvent reaches supercritical conditions. Under these conditions, the separation of the solvent and deasphalted oil is relatively easy. Solvent associated with the deasphalted oil and the pitch can be then stripped out at low pressure and recycled to the deasphalting unit.

Exemplary solvents for use in deasphalting unit 130 can include normal and isomerized paraffinic solvents having between 3 and 7 carbon atoms (i.e., from propane to heptane), and mixtures thereof. Deasphalting unit 130 can be operated at or below the supercritical temperature of the solvent (i.e., at or below about 97° C., 152° C., 197° C., 235° C., or 267° C. for propane, butane, pentane, hexane and heptane, respectively). Similarly, deasphalting unit 130 can be operated at a pressure at or below the supercritical pressure of the solvent (i.e., at or below about 42.5, 38, 34, 30, and 27.5 bars for propane, butane, pentane, hexane and heptane, respectively).

Deasphalting unit 130 produces deasphalted oil stream 134, which includes usable hydrocarbons, and pitch stream 136, which can include metals, aromatic compounds, asphaltenes, and the oxidized sulfur and nitrogen compounds.

Figure 2:
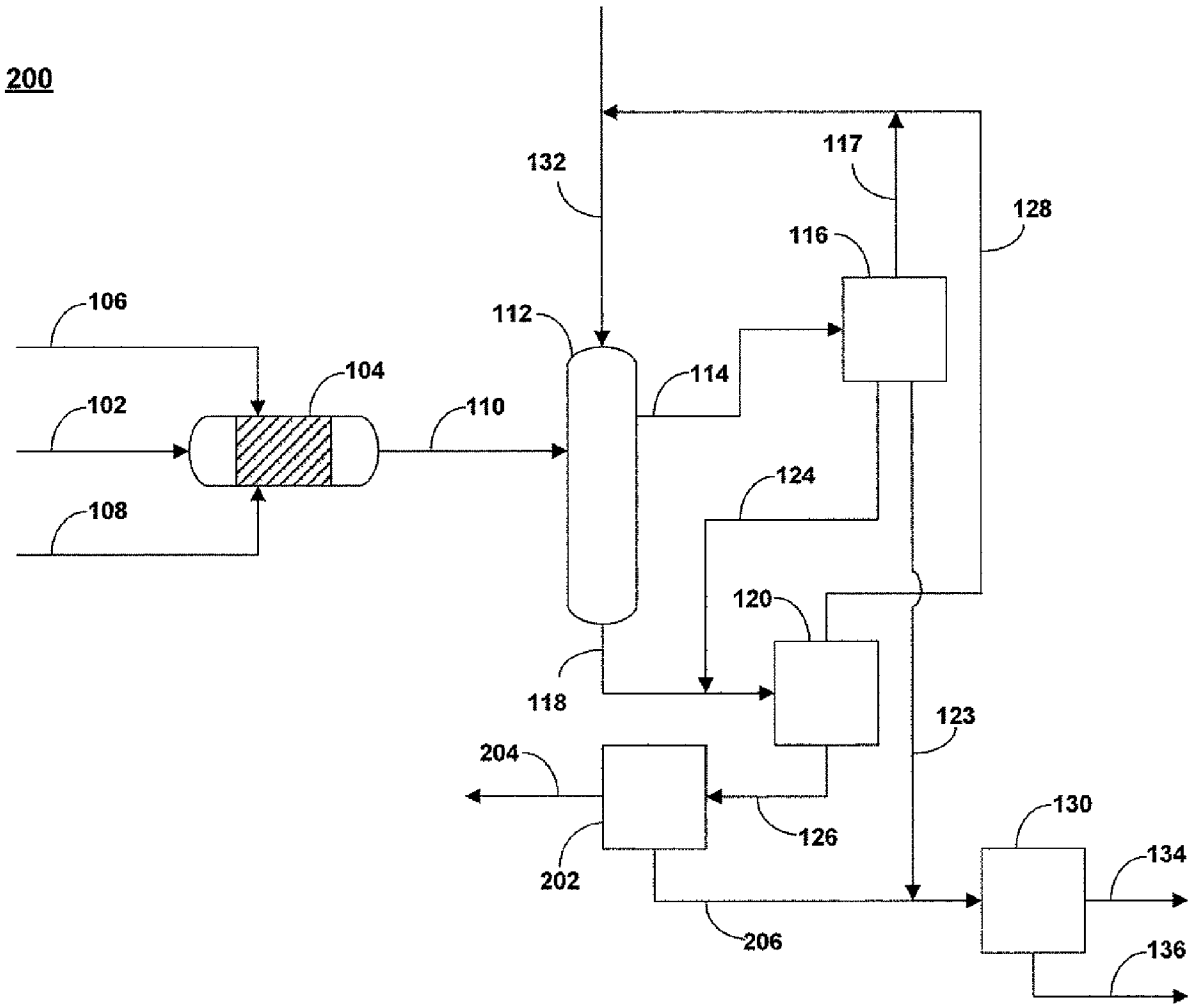
FIG. 2 provides a schematic diagram of one embodiment of the method of upgrading a hydrocarbon feedstock according to the present invention.

FIG. 2 provides one embodiment of the present invention for the upgrading of hydrocarbons. Hydrocarbon upgrading system 100 includes oxidation reactor 104, extraction vessel 112, solvent regeneration column 116, stripper 120, deasphalting unit 130, and adsorption column 202.

As shown in FIG. 2, in certain embodiments of the invention, stripped oil stream 126 can be supplied to adsorption column 202, where the stream can be contacted with one or more adsorbent designed to remove one or more of various impurities, such as sulfur containing compounds, oxidized sulfur compounds, nitrogen containing compounds, oxidized nitrogen compounds, and metals remaining in the hydrocarbon product stream after oxidation and solvent extraction steps.

Exemplary adsorbents can include activated carbon, silica gel, alumina, natural clays, and other inorganic adsorbents. In certain preferred embodiments, the adsorbent can include polar polymers that have been applied to or that coat various high surface area support materials, such as silica gel, alumina, and activated carbon. Exemplary polar polymers for use in coating various support materials can include polysulfones, polyacrylonitrile, polystyrene, polyester terephthalate, polyurethane, other like polymer species that exhibit an affinity for oxidized sulfur species, and combinations thereof.

The adsorption column can be operated at a temperature of between about 20° C. and 60° C., preferably between about 25° C. and 40° C., even more preferably between about 25° C. and 35° C. In certain embodiments, the adsorption column can be operated at a temperature of between about 10° C. and 40° C., alternatively between about 35° C. and 75° C. In certain embodiments, the adsorption column can be operated at temperatures of greater than about 20° C., or alternatively at temperatures less than about 60° C. The adsorption column can be operated at a pressure of up to about 15 bars, preferably up to about 10 bars, even more preferably between about 1 and 2 bars. In certain embodiments, the adsorption column can be operated at a pressure of between about 2 and 5 bars. In an exemplary embodiment, the adsorption column can be operated at a temperature of between about 25° C. and 35° C. and a pressure of between about 1 and 2 bars. The weight ratio of the stripped oil stream to the adsorbent is between about 1:1 and about 20:1, alternately between about 5:1 and about 15:1. In alternate embodiments, the ratio is between about 7:1 and about 13:1, with an exemplary ratio being about 10:1.

Adsorption column 202 separates the feed into extracted hydrocarbon product stream 204 having very low sulfur and very low nitrogen content and second residue stream 206. Second residue stream 206 includes oxidized sulfur and oxidized nitrogen compounds, and can be combined with first residue stream 123 and supplied to deasphalting unit 130 and processed as noted above. In certain embodiments, the adsorbent can be regenerated with a polar solvent that is operable to remove at least a portion of the molecules adsorbed to the surface of the adsorbent. Exemplary solvents include polar solvents, such as methanol and acetonitrile. In certain embodiments, heat can be supplied during the regeneration process to aid in the removal of adsorbed species from the surface of the adsorbent. In alternate embodiments, stripping gas can be utilized during the regeneration process to aid in the removal of adsorbed species from the surface of the adsorbent.

Example

Figure 3:
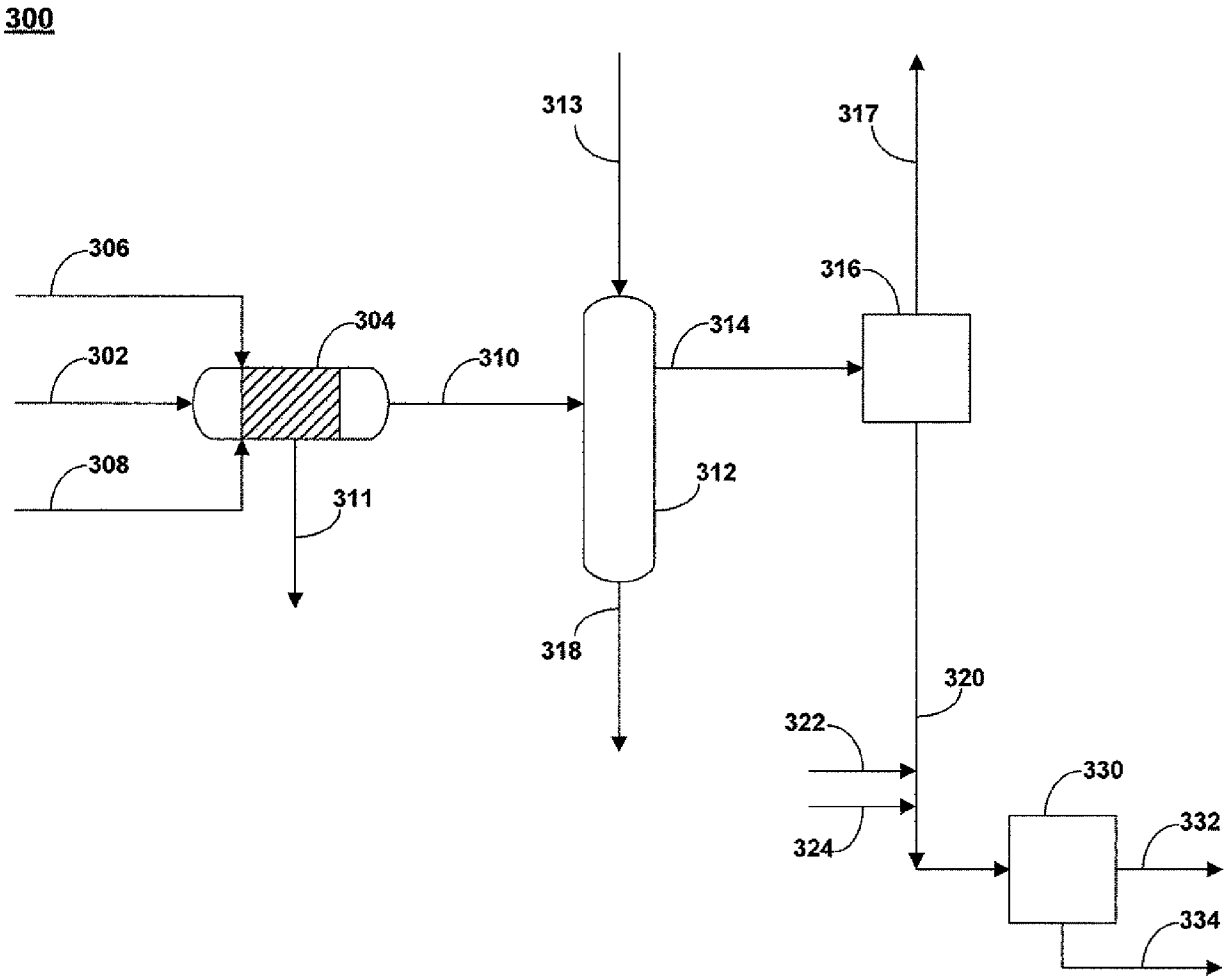
FIG. 3 provides a schematic diagram of one embodiment of the method of upgrading a hydrocarbon feedstock according to the present invention.

FIG. 3 shows one embodiment of the present invention. Diesel stream 302, which includes sulfur containing compounds, hydrogen peroxide oxidant stream 306 and catalyst stream 308, comprising acetic acid and $Na_2WO_4$ solid catalyst, were supplied to oxidation reactor 304, which was operated at conditions suitable to oxidize sulfur containing compounds present in the diesel stream, to produce oxidized sulfur containing diesel stream 310 and waste catalyst stream 311. Oxidation reactor 304 was maintained at a temperature of about 70° C. and a pressure of about 1 bar. The hydrogen peroxide to sulfur ratio was about 4:1, and the reactants were contacted for approximately 60 min. Oxidized sulfur containing diesel stream 310 is supplied to extraction vessel 312 where the diesel stream is contacted with methanol and heated to selectively remove the oxidized sulfur containing compounds from the diesel stream. Extraction vessel 312 is operated as described herein and produces extracted diesel stream 318 as a product stream, from which at least a portion of the sulfur containing compounds have been removed, and mixed stream 314, which includes oxidized sulfur compounds and methanol, and may also include trace amounts of diesel. The extraction was conducted at a temperature of about 25° C. and a pressure of about 1 bar, wherein the solvent to feed ratio was approximately 1:1 and the contract time between the extraction solvent and the feed was approximately 30 sec.

Mixed stream 314 was supplied to solvent regeneration column 316, where methanol stream 317 is separated from residue stream 320, which includes oxidized sulfur containing compounds, and may also include heavy hydrocarbons. Solvent regeneration column 316 was operated at a temperature of about 50° C. and a pressure of about 1 bar. Residue stream 320 is combined with pentane stream 322 and vacuum residue stream 324 and supplied to solvent deasphalting unit 330 to produce deasphalted oil stream 332, which includes deasphalted oil derived primarily from the vacuum residue stream, and asphaltene stream 334, which includes oxidized sulfur containing compounds. Solvent deasphalting unit was operated at a temperature of about 160° C. and a pressure of about 24 bar. The solvent to feed ratio was about 5% by volume. The solvent comprised butanes, consisting of about 86.8% by volume n-C4, about 2.6% by volume i-C5, and about 0.5% by volume n-C5.

The following tables provide the compositions of the various streams for the Example illustrated with FIG. 3. Table 1 shows the composition of the input and output streams for the oxidation step. Table 2 shows the composition of the input and output streams for the extraction step. Table 3 shows the composition of the input and output streams for the solvent deasphalting step.

TABLE 1

| | Oxidation | | | | |
|---|---|---|---|---|---|
| Stream | 302 (diesel) Kg/h | 306 ($H_2O_2$) Kg/h | 308 (catalyst) Kg/h | 311 (catalyst waste) Kg/h | 310 (oxidized sulfur containing diesel stream) Kg/h |
| Water | 0 | 974 | 0 | 8750 | 0 |
| Methanol | 0 | 0 | 0 | 0 | 0 |
| Diesel | 171,915 | 0 | 0 | 0 | 171,915 |
| Organic Sulfur | 519 | 0 | 0 | 2 | 517 |
| Acetic Acid | 0 | 0 | 10,641 | 10,641 | 0 |
| $H_2O_2$ | 0 | 292 | 0 | 0 | 0 |
| $Na_2WO_4$ (Kg) | 0 | 0 | 4,794 | 4,746 | 5 |
| Total | 172,434 | 1,266 | 15,435 | 24,139 | |

TABLE 2

| Extraction | | | | | | |
|---|---|---|---|---|---|---|
| Stream | 310 (oxidized sulfur containing diesel stream) Kg/h | 313 (MeOH) Kg/h | 314 (MeOH and oxidized sulfur compounds) Kg/h | 318 (diesel) Kg/h | 317 (MeOH) Kg/h | 320 (oxidized sulfur compounds) Kg/h |
| Water | 0 | 0 | 0 | 0 | 0 | 0 |
| Methanol | 0 | 266,931 | 266,724 | 207 | 266,724 | 0 |
| Diesel | 171,915 | 0 | 0 | 171,915 | 0 | 0 |
| Organic Sulfur | 517 | 0 | 512 | 5 | 0 | 507 |
| Acetic Acid | 0 | 0 | 0 | 0 | 0 | 0 |
| $Na_2WO_4$ (kg) | 5 | 0 | 5 | 0 | 0 | 0 |
| Total | 172,437 | 266,931 | 267,240 | 172,128 | 266,724 | 507 |

TABLE 3

| Solvent Deasphalting | | | | | |
|---|---|---|---|---|---|
| Stream | 320 (oxidized sulfur compounds) Kg/h | 322 (pentane) Kg/h | 324 (vacuum residue) Kg/h | 332 (deasphalted oil and pentane) Kg/h | 334 (asphaltenes and oxidized sulfur compounds) Kg/h |
| Stream Type | Feed | Solvent | Feed | Oil | Oil |
| Phase | Oil | Solvent | Oil | Oil | Oil |
| Vacuum residue | 0 | 0 | 10,000 | 0 | 0 |
| Oxidized sulfur compounds | 507 | 0 | 0 | 5 | 501 |
| Deasphalted oil | 0 | 0 | 0 | 7,105 | 0 |
| Asphaltenes | 0 | 0 | 0 | 0 | 2,895 |
| Pentane | 0 | 200 | 200 | 200 | 0 |
| Total | 507 | 200 | 10,200 | 7,310 | 3,390 |

While the Example corresponding to FIG. 3 is directed to the desulfurization of diesel fuel, it is understood that the process described can be operated with alternate hydrocarbon fluids or combinations of fluids.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

That which is claimed is:

1. A method of upgrading a hydrocarbon feedstock, the method comprising the steps of:

supplying the hydrocarbon feedstock to an oxidation reactor, the hydrocarbon feedstock comprising sulfur containing compounds;

contacting the hydrocarbon feedstock with an oxidant in the presence of a catalyst in the oxidation reactor under conditions sufficient to selectively oxidize sulfur containing compounds present in the hydrocarbon feedstock to produce an oxidized hydrocarbon stream that comprises hydrocarbons and oxidized sulfur containing compounds;

separating the hydrocarbons and the oxidized sulfur compounds in the oxidized hydrocarbon stream by solvent extraction with a non-acidic polar organic solvent, the non-acidic polar organic solvent being dimethylformamide, to produce an extracted hydrocarbon stream and a mixed stream, the mixed stream comprising the non-acidic polar organic solvent and the oxidized sulfur containing compounds, wherein the extracted hydrocarbon stream has a lower concentration of sulfur than the hydrocarbon feedstock;

separating the mixed stream using a distillation column into a first recovered non-acidic polar organic solvent stream and a first residue stream; and supplying the first residue stream to a deasphalting unit to produce a deasphalted oil stream and a pitch stream, wherein said pitch stream includes a substantial portion of the oxidized sulfur containing compounds removed from the hydrocarbon feedstock, wherein the hydrocarbon feedstock further comprises nitrogen containing compounds, such that the step of contacting the hydrocarbon feedstock with the oxidant in the presence the catalyst oxidizes at least a portion of the nitrogen containing compounds, wherein the first residue stream supplied to the deasphalting unit includes the oxidized nitrogen containing compounds, and wherein said pitch stream further includes a substantial portion of the oxidized nitrogen containing compounds removed from the hydrocarbon feedstock, the method further comprising the steps of supplying the extracted hydrocarbon stream to a stripper to produce a second recovered non-acidic polar organic solvent stream and a stripped hydrocarbon stream; and recycling the first recovered non-acidic polar organic solvent stream and the second non-acidic polar organic solvent stream to an extraction vessel for the step of separating the hydrocarbons and the oxidized sulfur compounds in the oxidized hydrocarbon stream.

2. The method of claim 1, wherein the oxidant is selected from the group consisting of air, oxygen, oxides of nitrogen, peroxides, hydroperoxides, organic peracids, and combinations thereof.

3. The method of claim 1, wherein the catalyst is a metal oxide having the formula $M_xO_y$, wherein M is an element selected from Groups IVB, VB, and VIB of the periodic table.

4. The method of claim 1, wherein the oxidation reactor is maintained at a temperature of between about 20 and 150° C. and at a pressure of between about 1-10 bars.

5. The method of claim 1, wherein the ratio of the oxidant to sulfur containing compounds present in the hydrocarbon feedstock is between about 4:1 and 10:1.

6. The method of claim 1, wherein the non-acidic polar organic solvent has a Hildebrandt value of greater than about 19.

7. The method of claim 1, wherein the solvent extraction is conducted at a temperature of between about 20° C. and 60° C. and at a pressure of between about 1-10 bars.

8. The method of claim 1, further comprising the step of supplying the extracted hydrocarbon stream to an adsorption column, the adsorption column being charged with an adsorbent suitable for the removal of oxidized compounds present in the extracted hydrocarbon stream, the adsorption column producing a high purity hydrocarbon product stream and a second residue stream, the second residue stream containing a portion of the oxidized sulfur containing compounds and oxidized nitrogen containing compounds.

9. The method of claim 8, further comprising supplying the second residue stream to the deasphalting unit.

10. The method of claim 8, wherein the adsorbent is selected from the group consisting of activated carbon, silica gel, alumina, natural clays and combinations of the same.

11. The method of claim 8, wherein the adsorbent is a polymer coated support, wherein the support has a high surface area and is selected from the group consisting of silica gel, alumina, and activated carbon, and the polymer is selected from the group consisting of polysulfone, polyacrylonitrile, polystyrene, polyester terephthalate, polyurethane and combinations of the same.

12. The method of claim 1, wherein the step of supplying the first residue stream to the deasphalting unit further comprises supplying a deasphalting solvent selected from a paraffinic solvent having between 3 and 7 carbon atoms to the deasphalting unit and extracting the first residue stream with the deasphalting solvent at a temperature and pressure at or below the critical temperature and pressure of the paraffinic solvent, wherein the deasphalted oil stream includes a major fraction of the paraffinic solvent.

13. A method of upgrading a hydrocarbon feedstock, the method comprising the steps of:

supplying the hydrocarbon feedstock to an oxidation reactor, the hydrocarbon feedstock comprising sulfur containing compounds;

catalytically oxidizing the sulfur containing compounds in the hydrocarbon feedstock in the oxidation reactor with an oxidant in the presence of a catalyst under conditions sufficient to selectively oxidize the sulfur containing compounds present in the hydrocarbon feedstock to sulfones and produce a treated hydrocarbon stream comprising hydrocarbons and sulfones;

extracting the treated hydrocarbon stream with a non-acidic polar organic solvent, the non-acidic polar organic solvent being dimethylformamide, to produce an extracted hydrocarbon stream and a mixed stream, the mixed stream comprising the non-acidic polar organic solvent and the sulfones, wherein the extracted hydrocarbon stream has a lower sulfur concentration than the hydrocarbon feedstock;

separating the mixed stream using a distillation column into a first recovered non-acidic polar organic solvent stream and a first residue stream comprising sulfones;

supplying the extracted hydrocarbon stream to a stripper, the stripper operable to separate the extracted hydrocarbon stream into a stripped oil stream and a second recovered non-acidic polar organic solvent stream;

recycling the first recovered non-acidic polar organic solvent stream and second recovered non-acidic polar organic solvent stream to the extraction step; and supplying the residue stream comprising sulfones to a deasphalting unit and extracting the residue stream with a paraffinic solvent having between 3 and 7 carbon atoms to produce a deasphalted oil stream and a pitch stream, wherein said extraction of the residue stream is conducted a temperature and pressure that is at or below the supercritical temperature and pressure of the paraffinic solvent, wherein the hydrocarbon feedstock further comprises nitrogen containing compounds, such that the step of catalytically oxidizing further comprises catalytically oxidizing the nitrogen containing compounds in the hydrocarbon feedstock with the oxidant in the presence of the catalyst, and wherein the residue stream supplied to the deasphalting unit includes the oxidized nitrogen containing compounds.

14. The method of claim 13 wherein the oxidation reactor is maintained at a temperature of between about 20 and 150° C. and at a pressure of between about 1-10 bars and the solvent extraction is conducted at a temperature of between about 20° C. and 60° C. and at a pressure of between about 1-10 bars.

15. The method of claim 13 wherein the non-acidic polar organic solvent has a Hildebrandt value of greater than about 19.

16. The method of claim 13, further comprising the step of supplying the extracted hydrocarbon stream to an adsorption column, the adsorption column being charged with an adsorbent suitable for the removal of oxidized compounds present in the extracted hydrocarbon stream, the adsorption column producing a high purity hydrocarbon product stream and a second residue stream, the second residue stream containing a portion of the oxidized compounds.

17. The method of claim 13, further comprising supplying the second residue stream to the deasphalting unit.

* * * * *